United States Patent [19]

Blanc

[11] 4,261,807

[45] Apr. 14, 1981

[54] ASYMMETRICAL ARRANGEMENT OF BUSBARS FOR ELECTROLYTIC CELLS

[75] Inventor: Jean M. Blanc, Sierre, Switzerland

[73] Assignee: Swiss Aluminium Ltd., Chippis, Switzerland

[21] Appl. No.: 132,397

[22] Filed: Mar. 20, 1980

[30] Foreign Application Priority Data

Feb. 1, 1980 [CH] Switzerland ..... 813/80

[51] Int. Cl.[3] ..... C25C 3/16

[52] U.S. Cl. ..... 204/243 M; 204/244

[58] Field of Search ..... 204/243 R, 243 M, 244, 204/245, 246, 247, 67

[56] References Cited

U.S. PATENT DOCUMENTS

| | | | |
|---|---|---|---|
| 4,072,597 | 2/1978 | Morel | 204/243 M |
| 4,132,621 | 1/1979 | Morel | 204/243 M |
| 4,176,037 | 11/1979 | Nebell | 204/243 M |
| 4,210,514 | 7/1980 | Morel | 204/243 M |

FOREIGN PATENT DOCUMENTS

| | | | |
|---|---|---|---|
| 1586867 | 3/1970 | France | 204/243 M |

*Primary Examiner*—T. M. Tufariello

*Attorney, Agent, or Firm*—Bachman and LaPointe

[57] ABSTRACT

Longitudinally arranged electrolytic cells for the production of aluminum in particular, incur high investment and operating costs due to the arrangement of the busbars outside the cells. These busbars induce magnetic fields which in turn cause stirring effects in the metal in the cell.

If at least the last cathode bar ends (in terms of the direction of flow I of current) on both sides of the cell are connected via busbars to the end of the anode beam at the current ingoing end of the next cell or the other end of the anode beam, this gives rise to an asymmetry which eliminates the harmful effects of the magnetic fields and helps to lower the investment and operational costs.

6 Claims, 3 Drawing Figures

ASYMMETRICAL ARRANGEMENT OF BUSBARS FOR ELECTROLYTIC CELLS

BACKGROUND OF THE INVENTION

The present invention relates to an asymmetrical arrangement of busbars for conducting the direct electrical current from the cathode bars of one longitudinal electrolytic cell, in particular for the production of aluminum, to the anode beam of the next cell via a plurality of busbars running along the long sides of the cell.

Aluminum is won by the electrolysis of aluminum oxide. For this purpose the aluminum oxide is dissolved in a fluoride melt made up mostly of cryolite. The aluminum which separates out at the cathode collects on the carbon floor of the cell, the surface of the liquid aluminum forming the cathode. Dipping into the melt are anodes which are suspended from anode beams or traverses. In the conventional reduction process these anodes are made of carbon. As a result of the electrolytic decomposition of the aluminum oxide, oxygen forms on the carbon anodes and combines with the carbon of the anodes to give $CO_2$ and CO. The electrolytic process generally takes place in a temperature range of about 940°–970° C. In the course of the process the electrolyte becomes depleted in aluminum oxide. At a lower concentration of 1–2 wt.% of aluminum oxide in the electrolyte, the anode effect suddenly occurs, which results in a voltage jump from, for example, 4–5 V to 30 V and more.

Then, at the latest, the crust of solidified electrolyte must be broken open and the concentration of aluminum hydroxide raised by the addition of new aluminum oxide (alumina).

Usually, the electrolytic cell is attended to periodically, even when no anode effect occurs, by breaking the crust open and adding alumina to the cell.

Embedded in the carbon floor of the cell are cathode bars, the ends of which project out of both sides of cell floor. These iron bars collect the electrolyzing current which flows to the carbon anodes in the next cell via the busbars outside the cell, the anode beams and anode rods. Due to the ohmic resistance from cathode bars to the anodes in the next cell there is a loss of energy which is of the order of 1 kWh/kg of aluminum produced. There have therefore been many attempts to optimize the arrangement of the busbars with respect to ohmic resistance. At the same time, however, consideration must be given to the vertical components of the induced magnetic field which, together with the horizontal components of current density, produce field forces in the liquid metal produced in the cell.

In an aluminum smelter with electrolytic cells arranged longitudinally the flow of current from cell to cell is as follows: The direct electric current leaves the cell via the cathode bars situated in the carbon floor of the cell. The ends of the cathode bars are connected by means of flexible strips to the collector rails or busbars which run along the long sides of the cells. The electric current is led from these busbars which run along the long sides of the cells, via other flexible strips and rising busbars, to both ends of the anode beam of the next cell. Depending on the type of cell, this distribution of current varies, in terms of the general direction of flow of current along the row of cells, between the incoming and outgoing ends of the anode beam, from 100–0% to 50–50%. Vertical anode rods which support the carbon anodes and feed electrical current to them are releasably attached to the anode beam. In the pot room of the smelter the direct current flows first through one row of cells which are connected in series, and then turns back to the output transformer via one or more rows of neighboring cells.

This return flow of current creates a vertical magnetic disturbance $H_z$, which can be estimated by the following equation which holds in general for conductors carrying electrical current:

$$H_z = \frac{I}{2\pi r}\ [A/m],$$

where I is the magnitude of the current in ampere and r is the average distance from the neighboring row of cells in meters (m).

The magnetic fields produced by neighboring rows of cells greatly disturb the desired magnetic symmetry in an electrolytic cell, as in certain regions in the cell they add to the cells own magnetic fields, and in other regions subtract from these.

The magnetic influence of the neighboring row of cells creates a first component which causes the metal in the cell to rotate, moving along the inner cell walls, and having a particularly harmful effect on the stability of the cell. The direction of rotation depends on whether the neighboring row of cells lies to the left or the right of the cell with respect to the general direction of flow of electrical current. As a result of the current distribution between the rising busbars there is a second stirring component which is such that in each half of the cell, in terms of the longitudinal direction, in the region of the middle third part of the cell there is rotation, with the directions of stirring running counter to each other.

As a result of the non-uniform distribution of current in the busbars and in the anode beam from one end of the cell to the other, a third stirring component arises in the four quarters of the cell. This comprises four whirlpools which are such that the directions of rotation in the diagonally opposite quarters are the same.

The superimposing of these three components of stirring causes the rate of flow of metal in the cell to vary markedly. Where all three modes of rotation act in the same direction the flow rate of metal is high, which causes the carbon lining to be eroded and shortens the service life of the cell.

The asymmetry produced by the magnetic fields and their superposition are, together with the horizontal components of current density, responsible not only for stirring of the metal but also for doming and fluctuations in the metal. As all these phenomena are disadvantageous, it is of great importance to be able to influence the distribution of the magnetic field on the basis of theoretical considerations and practical experience.

According to the present state of the art the asymmetric arrangement of the busbars is such that on the oppositelongitudinal sides of the cell a different number of cathode bars is connected to the busbars leading to the next cell, or the busbars are positioned at different distances from the long sides of the cells.

In the French Pat. No. 1 586 887, for example in FIG. 2, five cathode bars are connected to busbar 3, but only three to busbar 4. Both busbars 3 and 4 lead to the outgoing end of the anode beam in the next cell. This arrangement produces an asymmetry which counteracts the magnetic forces from the neighboring row of cells.

In FIG. 3 of the same French patent an arrangement is shown in which the busbar 3 is higher than busbar 4, which also leads to a desired asymmetry.

Accordingly, it is the principal object of the present invention to establish an asymmetrical arrangement of busbars for longitudinally positioned electrolytic cells for the production of aluminum in particular, whereby less metallic busbar material has to be employed and smaller losses in electrical energy occur. This arrangement of the busbars should in particular facilitate an economic conversion of existing cells.

SUMMARY OF THE INVENTION

The foregoing object is readily achieved by way of the present invention in that at least the busbars of one cell which are joined to the last (in terms of the direction of flow of electrical current along the row of cells) cathode bars on both sides of the longitudinal axis of the cell lead to different ends viz. the incoming and outgoing ends of the anode beam of the next cell.

The asymmetry in the arrangement of busbars is defined as the difference between the number of cathode bars connected to each long side of the cell at the end of the anode beam at the current outgoing end of the next cell divided by the total number of the cathode bars.

In the present invention the asymmetry is achieved in that at least the busbar which is connected to the last cathode bar end, preferably that on the other side from the neighboring row of cells, is led to the current ingoing end of the anode beam of the next cell, whereas at least the busbar connected to the last cathode bar end on the other long side of the cell is led to the current outgoing end of the anode beam of the next cell. In other words the busbars on both sides of the electrolytic cell, connected to the last cathode bar ends, never lead to the same ends of the anode beam, but instead one of these busbars always leads to the current ingoing end, the other of these busbars always to the current outgoing end.

The distribution of the cathode bar ends to the busbars running along the cells is usefully the same on both long sides of the cell e.g. if five cathode bars are connected to the first busbars on both long sides, five are likewise connected to each of the second busbars and four to each of the third busbars on both long sides of the cell.

The values of the above defined asymmetry lie usefully between 0.05 and 0.4, preferably between 0.1 and 0.2.

BRIEF DESCRIPTION OF THE DRAWINGS

The invention will now be described in greater detail with the help of drawings wherein.

DETAILED DESCRIPTION

Figure 1:
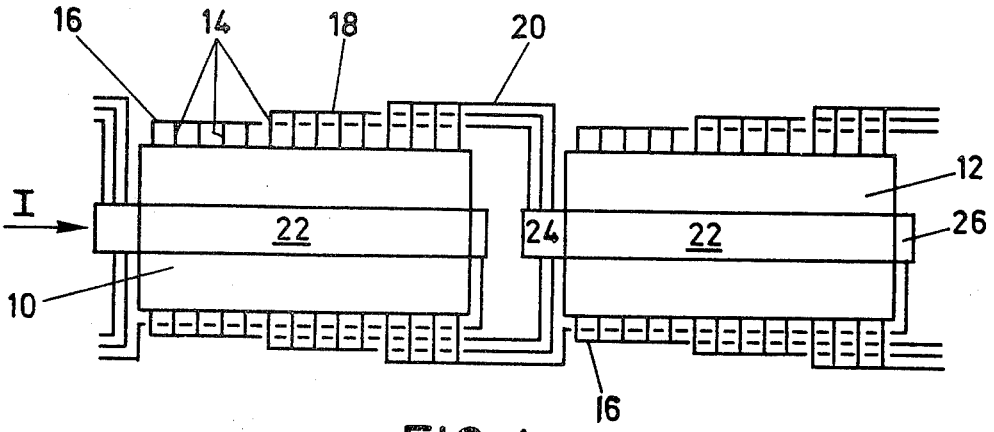
FIG. 1: Is an arrangement for leading current from the cathode bars of one cell with fourteen cathode bars to the anode beam of the next cell.

The electrolytic cells 10 and 12 shown in FIG. 1 represent part of a series of cells in an aluminum smelter. The general direction of flow of direct electrical current is indicated by I. Only the ends 14 of the cathode bars in the carbon floor of the cells are seen projecting out of cells 10,12.

The neighboring row of cells is not shown in FIG. 1, but with respect to the cell shown they run below that cell shown with the general direction of flow of current from right to left.

The first (with respect to the direction of current I) five cathode bars 14 on both sides of cells 10 and 12 are connected to the first busbars 16, the next five cathode bars 14 with the second busbars 18 and the last four bars 14 with the third busbars 20. The first and second busbars 16, 18 on both sides lead to the end 24 of the anode beam 22 at the current ingoing end of the next cell 12; of the third pair of busbars on cell 10 only the one on the left with respect to direction I to the end 24 of the anode beam 22 i.e. the one on the side of cell 10 facing away from the neighboring row of cells. The third busbar 20 on the right i.e. on the side facing the neighboring row of cells leads to the end 26 of the anode beam 22 at the current outgoing end of the cell 12.

In the embodiment of the invention according to FIG. 1 five rising busbars lead the current from twenty four cathode bar ends to the end 24 of the anode beam 22 at the ingoing end of the cell, while one rising busbar conducts the current from four cathode bars to the other end 26 of the anode beam at the outgoing end of the cell.

The asymmetry results because one of the third pair of busbars 20 leads the current to the anode beam at the ingoing end 24 and the other of that pair of busbars 20 leads current to the other end 24 of the anode beam i.e. at the current outgoing end of the cell. The asymmetry amounts to 1/7 or 0.14.

The arrangement of the busbars as in FIG. 1 removes the influence of the magnetic field due to the row of cells on the right (with respect to direction of the current I) which causes the liquid metal along the side of the cell to rotate. Likewise, the change in the distribution of the current between both ends of the anode beam eliminates the rotation in the two halves of the cell viz., that effect described above as the second component of the stirring action. There remains therefore only the third stirring component in the different quarters of the cell.

By eliminating two of the magnetic fields which cause stirring the rate of flow of the liquid metal can be reduced. Furthermore, because a third busbar 20 is led to the ingoing end 24 of the anode beam 22, busbar material can be saved, and the electrical losses reduced.

Figure 2:
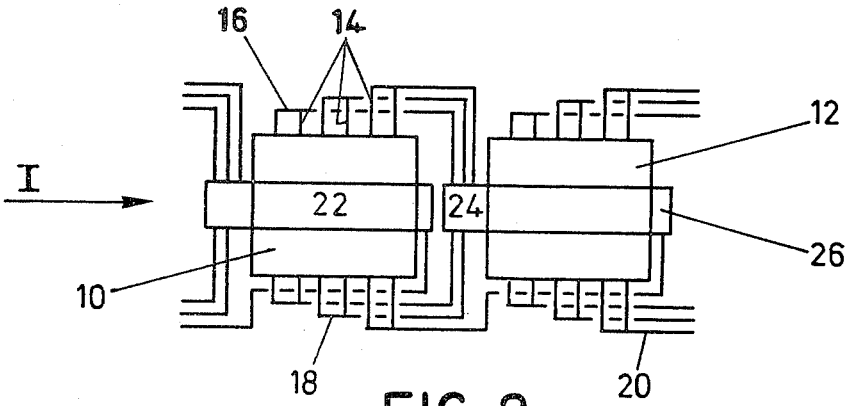
FIG. 2: Is an arrangement for conducting the current to and from an electrolytic cell with six cathode bars.

The embodiment shown in FIG. 2 differs from that in FIG. 1 only by having a smaller number of cathode bars (six instead of fourteen). In FIG. 2 the result is an asymmetry of 1/6 or 0.17.

Figure 3:
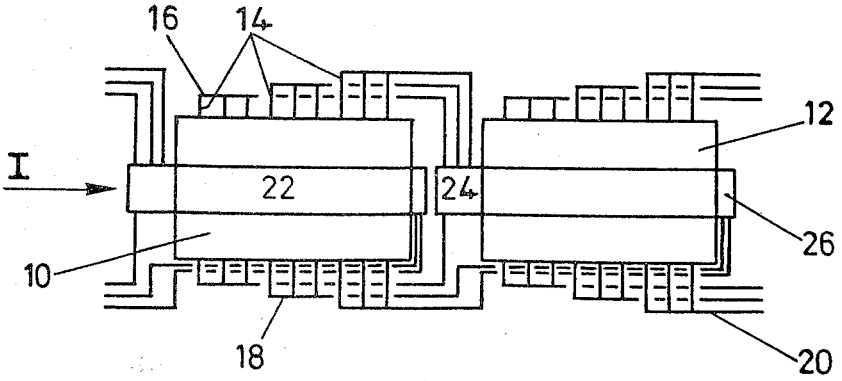
FIG. 3: Is an arrangement for conducting the current to and from a cell with nine cathode bars.

FIG. 3 shows an embodiment of the invention in which there are nine cathode bars. The asymmetry is produced not only by leading busbar 20 connecting the last three cathode bars, on the side of the neighboring row of cells, to end 26 of the cathode bar at the outgoing end of the next cell, but also the busbar 18 connecting the ends of the three middle cathode bars. The asymmetry amounts to 1/3 or 0.33.

According to another version, not shown here, the busbars 18 and 20 on the side facing the neighboring row of cells—as shown in FIG. 3—lead to the anode beam at the end 26 viz., at the outgoing end of the cell; on the other hand, the busbar on the side of the cell facing away from the neighboring row of cells and connecting up with the last of the cathode bars (in terms of the direction of current I) is not connected to the end of the anode beam at the ingoing end of the cell but to the end of the anode beam at the outgoing end of the cell. This results in an asymmetry of 1/6 or 0.17.

What is claimed is:

1. An arrangement for asymmetrically conducting direct electrical current from one electrolytic cell to another electrolytic cell comprising:

a first electrolytic cell and a second electrolytic cell arranged longitudinally of and downstream from with respect to the flow of current said first electrolytic cell, said first electrolytic cell having a plurality of cathode bars located on both sides of the central axis of said first electrolytic cell and said second electrolytic cell having an anode beam with a first end at the current ingoing end of said second electrolytic cell and a second end at the current outgoing end;

a plurality of busbars each connected to at least one of said plurality of cathode bars and to said anode beam wherein at least the last cathode bar closest to said second electrolytic cell is connected on both sides thereof to both ends of said anode beam at the current ingoing end and the current outgoing end so as to reduce the harmful effects of magnetic fields induced by parallel neighboring electrolytic cells.

2. An arrangement according to claim 1 wherein the busbar connecting said last cathode bar connects that side of the cathode bar farthest away from said neighboring row of cells to the end of the anode beam at the current ingoing end of the cell and that side closest to said neighboring row of cells to the end of the anode beam at the current outgoing end of the cell.

3. An arrangement according to claim 1 wherein said plurality of cathode bars on both sides of the cell are connected in equal numbers to said busbars.

4. An arrangement according to claim 1 wherein the asymmetry amounts to 0.05 to 0.4.

5. An arrangement according to claim 4 wherein the asymmetry amounts to 0.1 to 0.2.

6. An arrangement according to claim 1 wherein the number of cathode bars is fourteen and the last four cathode bars closest to said second electrolytic cell are connected to said anode beam such that that side of the cathode bars farthest away from said neighboring row of cells are connected to the end of the anode beam at the current ingoing end of the cell and that side closest to said neighboring row of cells are connected to the end of the anode beam at the current outgoing end of the cell.

* * * * *